United States Patent [19]

Paschal, Jr.

[11] 4,339,001

[45] Jul. 13, 1982

[54] SAFETY VALVE

[75] Inventor: James H. Paschal, Jr., Dallas, Tex.

[73] Assignee: Otis Engineering Corporation, Dallas, Tex.

[21] Appl. No.: 196,447

[22] Filed: Oct. 14, 1980

[51] Int. Cl.[3] ..... E21B 33/00

[52] U.S. Cl. ..... 166/322; 166/323; 137/460

[58] Field of Search ..... 137/460; 166/323, 321, 166/319, 322

[56] References Cited

U.S. PATENT DOCUMENTS

| | | | |
|---|---|---|---|
| 3,765,443 | 10/1973 | Young | 137/460 |
| 3,794,112 | 2/1974 | Hill | 166/321 X |
| 3,827,501 | 8/1974 | Johnson | 166/221 X |

*Primary Examiner*—Harold W. Weakley
*Attorney, Agent, or Firm*—Thomas R. Felger

[57] ABSTRACT

A differential pressure operated subsurface safety valve (20). A latch mechanism, having ball detents (63), holds the safety valve (20) open until the difference in pressure between fluid in chamber (40) within the safety valve (20) and fluid flowing through the safety valve (20) exceeds a preselected value. The difference in pressure acts upon a piston (37) which is attached to an actuator sleeve (31) causing the actuator sleeve (31) to shift the safety valve (20) from its open to its closed position. The chamber (40) is charged by and equalized with fluid pressure around the exterior of the safety valve (20).

16 Claims, 12 Drawing Figures

SAFETY VALVE

BACKGROUND OF THE INVENTION

1. Field of the Invention

The present invention discloses a pressure differential operated or direct acting safety valve.

2. Description of the Prior Art

Gas storage wells are frequently located in depleted hydrocarbon reservoirs at a relatively shallow depth less than five thousand feet. Common characteristics of gas storage wells are relatively low flowing pressures, less than three thousand psi, and a large unrestricted flow area. Examples of subsurface safety valves particularly adapted for use in gas storage wells are shown in U.S. Pat. Nos. 3,481,362; 3,459,260; and 3,491,831. Each of these patents was invented by William W. Dollison and assigned to Otis Engineering Corporation. U.S. Pat. Nos. 3,481,362; 3,459,260; and 3,491,831 are incorporated by reference for all purposes within this application.

Direct acting subsurface safety valves, which are closed by an increase in the fluid flow rate through the valve, are shown in U.S. Pat. No. 3,070,119 invented by George M. Raulins and U.S. Pat. No. 3,126,908 invented by George C. Dickens. Both of these patents disclose using a ball type detent mechanism to hold the respective valve closure means open until the flow rate through the respective valve exceeds a preselected value. U.S. Pat. Nos. 3,070,119 and 3,126,908 are incorporated by reference for all purposes within this application.

Various types of direct acting subsurface safety valves are commercially available under the trademark STORM CHOKE, registration no. 695,910, assigned to Otis Engineering Corporation.

SUMMARY OF THE INVENTION

The present invention discloses a safety valve for installation within a well flow conductor comprising a housing means with a longitudinal flow passageway extending therethrough, a valve closure means having a first position allowing fluid flow through the longitudinal flow passageway and a second position blocking fluid flow through the longitudinal flow passageway, means for latching the valve closure means in its first position, an actuator sleeve slidably disposed within the housing means and partially defining the longitudinal flow passageway, a piston means attached to the actuator sleeve and partially defining a variable volume fluid chamber between the exterior of the actuator sleeve and the interior of the housing means, means for equalizing fluid pressure between the chamber and fluid pressure exterior to the housing means, the actuator sleeve having means for releasing the latching means, and means for shifting the valve closure means from its first position to its second position after the latching means has been released.

One object of the present invention is to provide a new and improved pressure differential operated safety valve which is releasably held open (first position) by a latching means until a pressure differential of predetermined value occurs between the pressure within a variable volume chamber within the valve and the pressure of fluids through the valve.

Another object is to provide a pressure differential operated safety valve having a gas chamber with means for equalizing pressure in the gas chamber with fluid pressure exterior to the safety valve.

A further object of the present invention is to provide a safety valve which closes (second position) upon the occurrence of a pressure differential of predetermined value and will open when the pressure differential is equalized.

A still further object is to provide a latching means and actuator means for a safety valve which will accommodate minor differential pressure fluctuations and/or slow changes in the pressure of fluids flowing through the valve without shifting the valve closure means to its second position.

Another object is to provide a safety valve which minimizes the number of moving parts and significantly reduces the possibility of seal failure causing the valve to malfunction.

A further object is to provide a safety valve for installation in a well flow conductor to control the flow of well fluids therethrough including a housing, an actuator sleeve slidably disposed within the housing, means for engaging the actuator sleeve with a valve closure means to shift the valve closure means from its first, open position to its second, closed position. The safety valve also has a latching means engageable with the housing holding the valve closure means in its first position until released by the actuator sleeve.

Additional objects and advantages of the present invention will be readily apparent to those skilled in the art from reading the following written description in conjunction with the drawings and claims.

DESCRIPTION OF THE PREFERRED EMBODIMENTS

Figure 1:
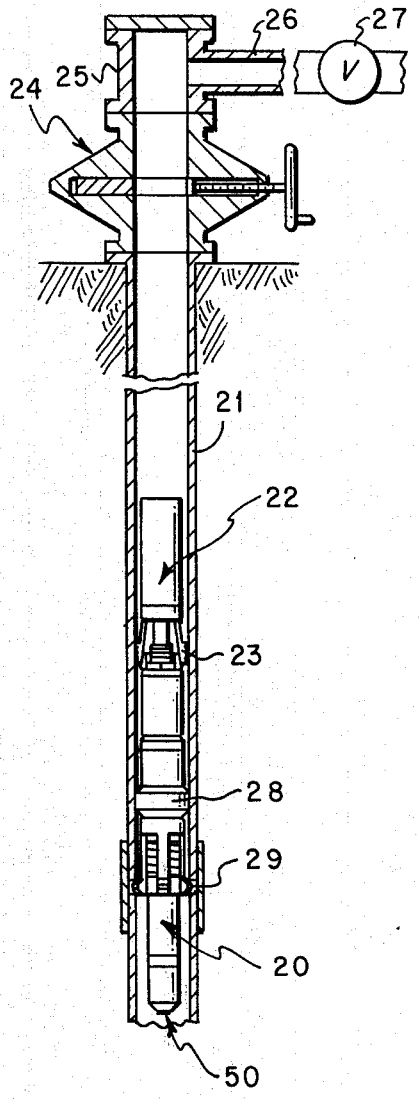
FIG. 1 is a schematic view partially in section showing a subsurface safety valve system embodying the present invention with the safety valve in its second position.

Referring to the drawings and particularly FIG. 1, subsurface safety valve 20 is shown releasably locked within well casing 21. At the well surface, a suitable master valve 24 is secured to the upper end of casing 21. Flow tee 25 is secured to the top of master valve 24. Surface flow line 26 extends horizontally from flow tee 25 with wing valve 27 controlling fluid flow therethrough.

Safety valve 20 is attached to lock assembly 22 which includes slip assembly 23, external annular seal assembly 28, and collet assembly 29. Lock assembly 22 is designed for collet assembly 29 to engage a collar recess within casing 21 and for slip assembly 23 to engage the inner wall of casing 21 while seal assembly 28 blocks fluid flow between the exterior of lock assembly 22 and the inner wall of casing 21. A detailed description of the installation and removal of lock assembly 22 is contained within U.S. Pat. No. 3,459,260 which has been incorporated by reference for all purposes. Safety valve 20 can be installed downhole within either a well casing or a tubing string by using other well-known lock assemblies.

Figure 2A:
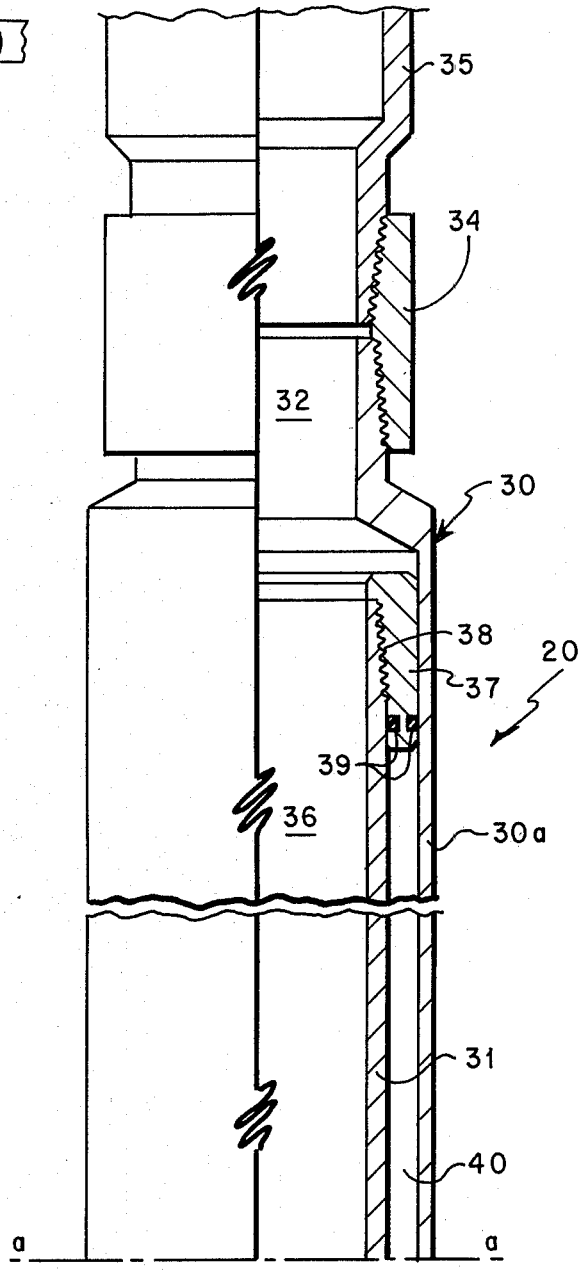
FIGS. 2A and 2B are drawings, partially in section and partially in elevation, showing the safety valve in its closed position.
Figure 2B:
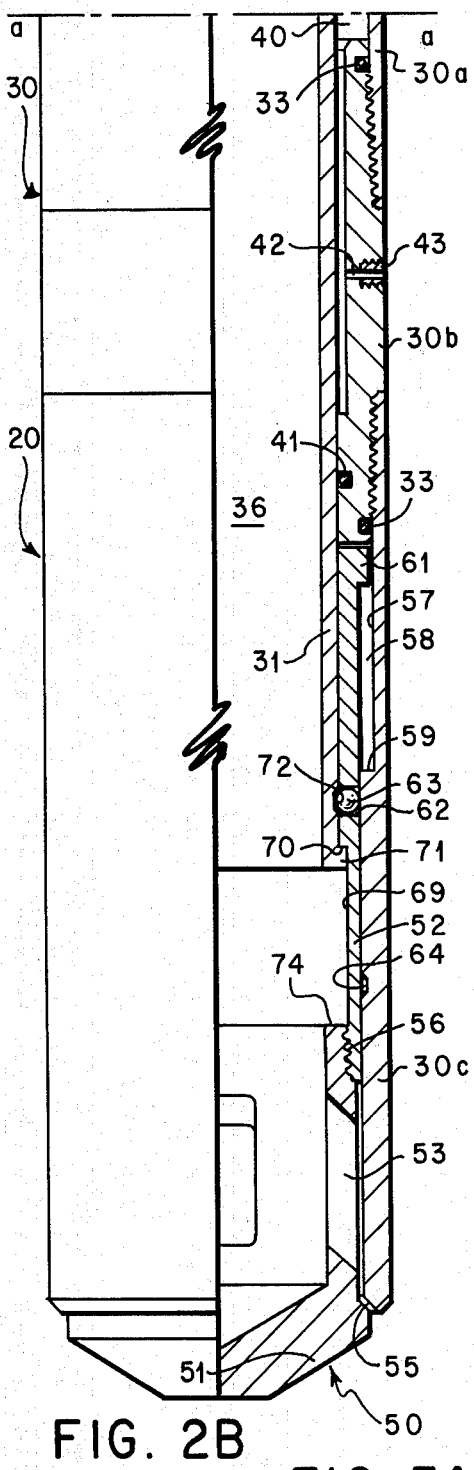

Referring to FIGS. 2A and 2B, safety valve 20 is shown in its second position with valve closure means 50 blocking fluid flow therethrough. Within this application, valve closure means 50 is shown as a poppet type valve closure means. However, as shown in U.S. Pat. No. 3,273,588 to W. W. Dollison, actuator sleeve 31 could be used to open and close either a ball or flapper type valve closure means in addition to the poppet type. U.S. Pat. No. 3,273,588 is incorporated by reference for all purposes within this application.

The exterior of safety valve 20 is defined by tubular housing 30 with longitudinal flow passageway 32 extending therethrough. For ease of manufacture and assembly, tubular housing 30 has three subassemblies 30*a*, 30*b*, and 30*c*. Each housing subassembly is generally cylindrical with a longitudinal bore extending therethrough. Each housing subassembly is threadedly engaged to adjoining subassemblies with appropriate o-ring seals 33 to prevent undesired fluid communication between the interior and exterior of housing 30. The longitudinal bores of each housing subassembly are concentrically aligned to partially define longitudinal flow passageway 32.

In FIG. 2A, coupling 34 secures housing subassembly 30*a* to connector sub 35 of any suitable lock assembly for anchoring safety valve 20 within a well flow conductor. Preferably, the lock assembly will form a seal with the well flow conductor above safety valve 20 so that the flow of well fluids through the well flow conductor can take place only through safety valve 20. Examples of other lock assemblies in addition to lock assembly 22 are shown on pages 5324 and 5326 of the Composite Catalog of Oilfield Equipment and Services, 1978–79 Edition.

Actuator sleeve 31 is slidably disposed within housing 30 and forms an annulus between the exterior of sleeve 31 and the inside diameter of housing 30. Longitudinal bore 36 extends through sleeve 31. Bore 36 partially defines longitudinal flow passageway 32 through valve 20. Piston means 37 is engaged by threads 38 to one end of sleeve 31. Piston seals 39, carried by piston means 37, form a fluid tight barrier between the exterior of sleeve 31 and the inside diameter of housing 30. Actuator sleeve 31 and piston means 37 comprise a portion of the means for actuating valve closure means 50 to shift it to its second position.

Variable volume chamber 40 is formed within the annulus between housing 30 and sleeve 31 by piston seals 39 and o-ring seal 41. O-ring seal 41 is carried on the inside diameter of housing subassembly 30*b* and engages the exterior of sleeve 31 spaced longitudinally from piston means 37.

Port 42 extends through housing 30 and allows communication of fluid pressure from the exterior of safety valve 20 with chamber 40. Preferably, choke 43, threadedly engaged with port 42, has an orifice or opening 44 extending therethrough and communicating with port 42.

As will be explained later, choke 43 can be selected to have various sizes of openings 44. The selection of choke 43 determines the rate at which pressure differences between fluid within chamber 40 and fluid around the exterior of valve 20 are equalized.

Figure 7:
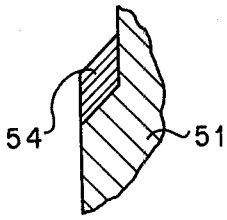
FIG. 7 is an enlarged view in section with portions broken away showing the sealing means carried on the valve closure means of FIG. 5.

Valve closure means 50 has two subassemblies, valve means 51 and valve extension 52. Valve means 51 is the poppet type having four flow openings 53. Flow openings 53 are generally rectangular with inwardly slanted surfaces to minimize flow restriction. One advantage of a poppet type valve means 51 is that the total area of openings 53 can be selected to be larger than the flow area of the well flow conductor in which valve 20 is installed. Valve means 51 also carries an annular sealing means or seal ring 54. End surface 55 of housing subassembly 30*c* functions as a valve seat to form a fluid tight barrier when annular sealing means 54 contacts end surface or valve seat 55 (second position of valve closure means 50). Sealing means 54 may either be a hard metal insert as shown in FIG. 7 or elastomeric material as desired.

Valve extension 52 is a generally tubular member attached to valve means 51 by threads 56. The inside and outside diameter of valve extension 52 are selected to allow valve extension 52 to fit within the annulus between actuator sleeve 31 and housing subassembly 30*c*. Housing subassembly 30*c* has an enlarged inside diameter 57 adjacent to housing subassembly 30*b*. Enlarged inside diameter 57 forms an annular recess 58 between valve extension 52 and housing subassembly 30*c*. The ends of recess 58 are defined by shoulder 59 on the interior of subassembly 30*c* and end 60 of subassembly 30*b*. Flange or rim 61 is formed on the end of valve extension 52 opposite valve means 51. Flange 61 is slidably disposed within recess 58. Longitudinal movement of valve closure means 50 towards its first position is limited by flange 61 abutting shoulder 59.

A plurality of radial openings 62 extend through valve extension 52 intermediate the ends thereof. One detent ball 63 is disposed within each opening 62. Housing subassembly 30*c* has annular groove 64 machined on the inside diameter thereof intermediate shoulder 59 and end surface 55. The longitudinal spacing of openings 62 from flange 61 and groove 64 from shoulder 59 is selected to allow balls 63 to fit within groove 64 when flange 61 abuts shoulder 59. Balls 63 and groove 64 comprise a portion of the means for latching valve closure means 50 in its first position.

Valve extension 52 has an enlarged inside diameter portion 69 spaced longitudinally between valve means 51 and openings 62. Shoulder 70 is formed by inside diameter portion 69 and faces valve means 51. Flange or rim 71 is formed on the end of actuator sleeve 31 opposite piston means 37. Flange 71 is sized to be slidable within inside diameter portion 69. Flange 71 engages shoulder 70 to allow actuator sleeve 31 to shift valve closure means 50 from its first position to its second position. Annular groove 72 is formed in the exterior of actuator sleeve 31 spaced longitudinally from flange 71. The dimensions of annular grooves 64 and 72 and balls 63 are selected to be compatible. The diameter of balls 63 is larger than the thickness of valve extension 52 at openings 62. Therefore, balls 63 must either project from openings 62 into annular groove 64 or annular groove 72 when valve extension 52 is assembled between actuator sleeve 31 and housing subassembly 30*c*.

Normal Operation

Figure 3A:
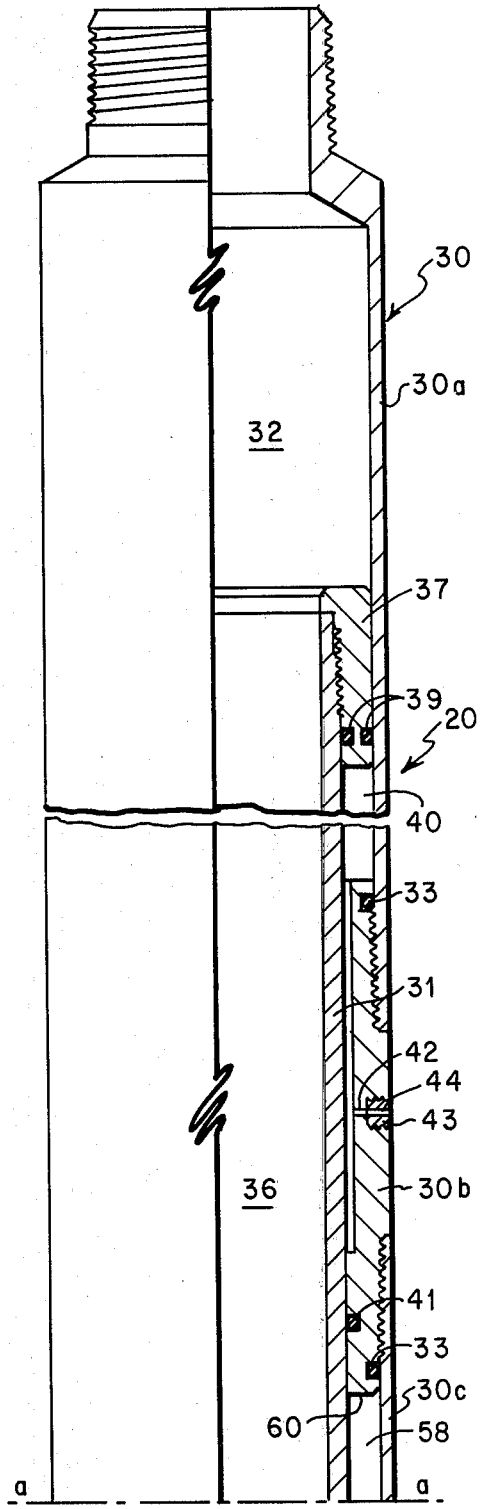
FIGS. 3A and 3B are drawings, partially in section and partially in elevation, showing the safety valve in its first position.
Figure 3B:
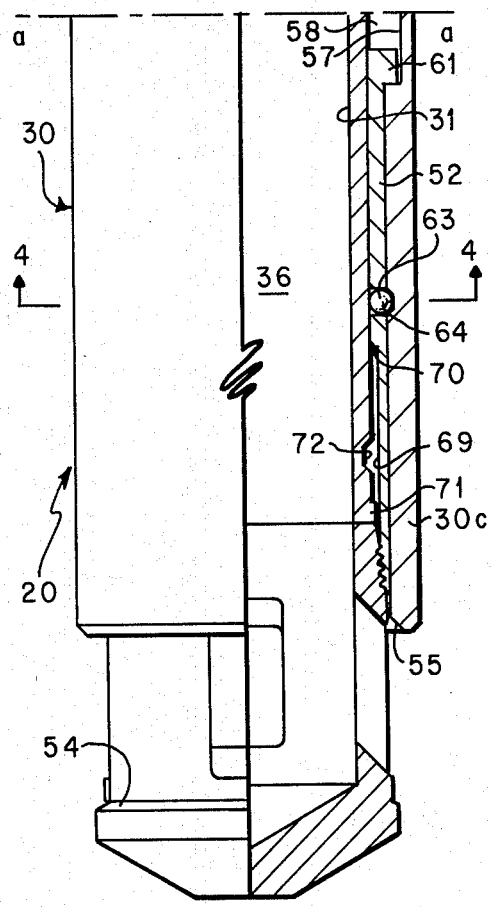
Figure 5:
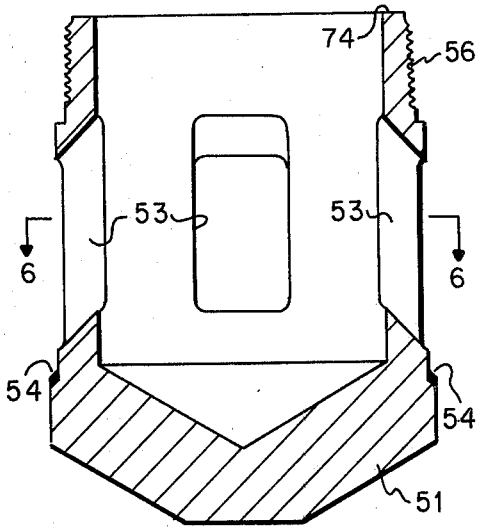
FIG. 5 is an enlarged drawing in vertical section of a poppet type valve closure means.
Figure 6:
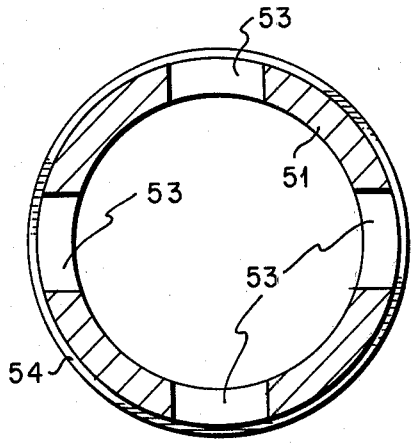
FIG. 6 is a view in section along line 6—6 of FIG. 5.
Figure 4:
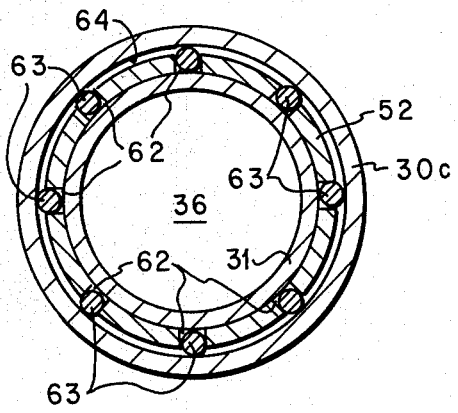
FIG. 4 is a view in section along line 4—4 of FIG. 3B showing the latching means.

Referring to FIGS. 3A and 3B, safety valve 20 is shown in its first position allowing fluid flow therethrough. This is the normal position for safety valve 20 while installed within a well flow conductor and producing well fluids. A suitable packing means such as seal assembly 28 directs fluid flow within the well flow conductor through openings 53 and longitudinal flow passageway 32 to the well surface. During normal operation, the exterior of actuator sleeve 31 forces balls 63 to project radially outward from openings 62 and engage annular groove 64. Thus, valve closure means 50 is releasably latched in its first position by the engagement of balls 63, carried within valve extension 52, with annular groove 64 of housing subassembly 30c.

During normal flowing conditions, the pressure of fluids exterior to safety valve 20 will be equalized with the pressure within variable volume chamber 40 through port 42. As previously noted, the flow area of openings 53 in valve means 51 can be selected to be larger than the flow area of the well flow conductor above safety valve 20. Minimizing restriction to flow reduces the difference in well fluid pressure exterior to safety valve 20 and within longitudinal flow passageway 32. In a gas storage well, this difference in pressure would be very small. Thus, an important feature of the present invention is that seals 39, 33, and 41 are subjected to very little or no difference in pressure during normal operation which greatly increases seal life.

During normal operation, valve closure means 50 is latched in its first position with flange 71 of actuator sleeve 31 spaced longitudinally from shoulder 70 of valve extension 52. Generally, actuator sleeve 31 will rest upon shoulder 74 of valve means 51 during normal operation.

Gradual, slow changes in the pressure of well fluids flowing within longitudinal flow passage 32 are expected as the underground reservoir is depleted. Changes in pressure within longitudinal passageway 32 can also be caused by changes in production rate. Variations in ambient temperature at the well surface will also vary the pressure of fluids within longitudinal flow passageway 32, especially for gas storage wells. However, all of the above pressure changes are fairly slow. Choke 43 is selected so that orifice 44 has sufficient size to maintain pressures essentially equal between chamber 40 and the exterior of safety valve 20.

Slight variations in pressure between chamber 40 and flow passageway 32 are compensated for by piston means 37 moving longitudinally away from seal 41. This movement increases the volume of chamber 40 until the pressure difference is equalized. This movement of piston means 37 also moves actuator sleeve 31 in one direction with respect to valve closure means 50. However, valve closure means 50 remains locked in its first position as long as the longitudinal movement of actuator sleeve 31 does not place annular groove 72 adjacent balls 63. Longitudinal movement of actuator sleeve 31 by slight differences in pressure is also resisted by the weight of actuator sleeve 31 and piston means 37 plus the friction of seals 39 and 41. Thus, valve closure means 50 remains latched in its first position despite minor pressure changes within longitudinal flow passageway 32.

Emergency Valve Closure

During a casualty situation such as a rupture of flow tee 25 or flow line 26, the well fluid flow rate through longitudinal flow passageway 32 will increase rapidly. The increase in flow rate causes a sharp decrease in pressure within longitudinal flow passageway 32 as compared to the pressure in chamber 40. This large pressure differential causes actuator sleeve 31 to move in the one direction until annular groove 72 is adjacent balls 63. Balls 63 can now project inwardly through openings 62 and unlatch valve closure means 50 from housing means 30. At the same time flange 71 contacts shoulder 70. Since valve closure means 50 is now unlatched, piston means 37 can continue to move actuator sleeve 31 in the one direction shifting valve closure means 50 to its second positon. Longitudinal movement of actuator sleeve 31 stops when annular seal ring 54 firmly engages valve seat 55. With valve closure means 50 in its second position, pressure within longitudinal flow passageway 32 will decrease more rapidly due to the rupture while the pressure in chamber 40 remains high due to port 42. This increased pressure difference causes firmer contact between annular seal ring 54 and valve seat 55. In a gas storage well, the pressure in longitudinal flow passageway 32 should decrease to essentially atmospheric pressure under these conditions.

Return to Normal Operation

Once actuator sleeve 31 has released the latching means and shifted valve closure means 50 to its second position, safety valve 20 will remain closed to fluid flow until action is taken at the well surface.

Valve closure means 50 can be returned to its first position by equalizing the pressure difference between longitudinal flow passageway 32 and gas chamber 40 after the condition causing safety valve 20 to close has been corrected. For gas storage wells, equalizing pressure is a fairly simple procedure because the typical gas storage well includes the necessary surface equipment to inject gas into the underground reservoir. When the pressures are equalized, the force of gravity acting on valve closure means 50 will cause it to slide in the other direction relative to housing means 30 until flange 61 abuts shoulder 59. This longitudinal movement also positions balls 63 adjacent annular groove 64 in housing subassembly 30c. The weight of actuator sleeve 31 will also cause movement in the other direction until flange 71 abuts shoulder 74. This movement of actuator sleeve 31 in the other direction causes balls 63 to be project outwardly, by the exterior of actuator sleeve 31 about groove 72, through openings 62 and engage annular groove 64. Thus, valve closure means 50 is latched in its first portion. In a gas storage well, shifting valve closure means 50 to its first position and latching valve closure means to housing means 30 could be easily accomplished by injecting gas from the well surface into the underground reservoir. Injection of gas is a routine procedure in the operating cycle of a gas storage well.

Alternative Embodiment

Figure 8A:
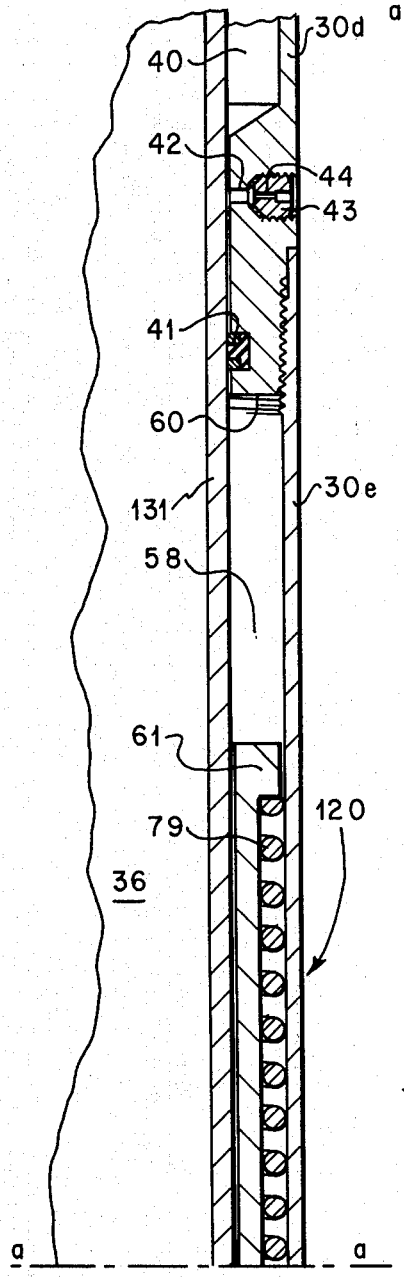
FIGS. 8A, 8B and 8C are schematic drawings in section with portions broken away showing an alternative embodiment of the present invention.
Figure 8B:
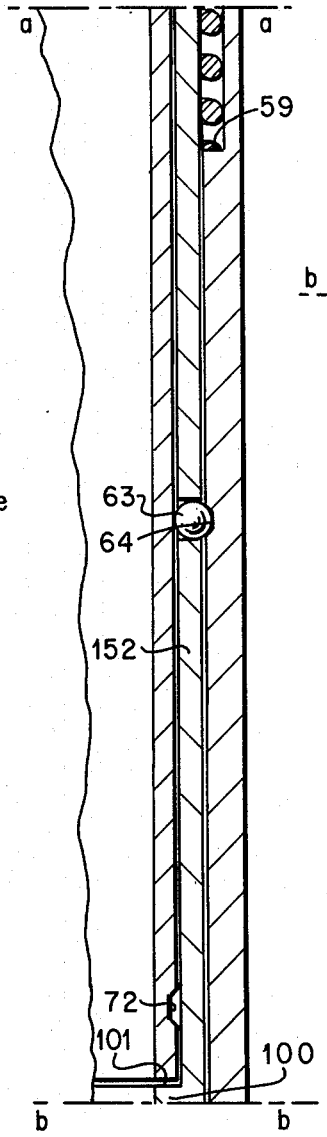
Figure 8C:
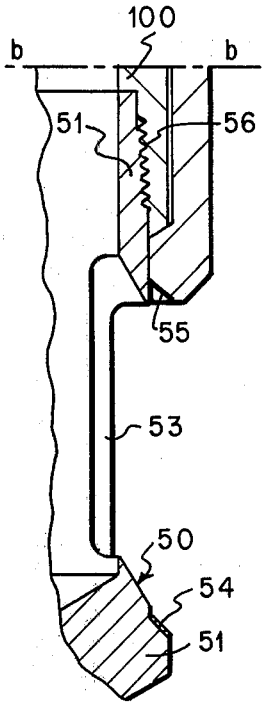

Referring to FIG. 8 an alternative embodiment of the present invention is designated as safety valve 120. Many of the components of safety valve 20 are identical with those of safety valve 120. In safety valve 20, actuator sleeve 31 performs two major functions. First, actuator sleeve 31 moves longitudinally to position groove 72 to unlatch valve closure means 50 from housing subassembly 30c. Secondly, flange 71 on actuator sleeve 31 engages shoulder 70 to shift valve closure means 50 from its first position to its second position. In safety valve 120, modified actuator sleeve 131 only positions groove 72 adjacent balls 63 to unlatch valve closure means 50 from housing subassembly 30c. Spring 79, carried within recess 58 between flange 61 and shoulder 59, provides the force required to shift valve closure means 50 from its first to its second position.

Actuator sleeve 131 is nearly identical to actuator sleeve 31 except flange 71 has been removed from the end opposite piston means 37. Valve extension 152 is a portion of the means for latching valve closure means 50 in its first position in the same manner as valve extension 52. However, shoulder 70 is not formed on the inside diameter of valve extension 152. The overall length of valve extension 152 is longer than valve extension 52 to compensate for the presence of spring 79. Flange 100 is formed on the inside diameter of valve extension 152 to provide an upwardly facing shoulder 101 for actuator sleeve 131 to rest upon.

Housing 30 of safety valve 120 has only two subassemblies 30d and 30e. Housing subassembly 30d merely shows that housing subassemblies 30a and 30b of safety valve 20 could be combined into a single component if desired. Housing subassembly 30e is essentially identical to housing subassembly 30c except recess 58 is longer to accomodate spring 79.

Normal Operation

During normal flow conditions, valve closure means 50 of safety valve 120 is latched in its first position as shown in FIG. 8. The exterior of actuator sleeve 131 forces balls 63 to project radiallly outward engaging groove 64 of housing subassembly 30e. Spring 79 is compressed between flange 61 and shoulder 59

Emergency Valve Closure

As previously explained when fluid flow rapidly increases through bore 36, the difference in pressure as compared to variable volume chamber 40 causes actuator sleeve 131 to move in the one direction until groove 72 is adjacent balls 63. This movement of actuator sleeve 131 allows balls 63 to move radially inward and out of contact with groove 64. Valve closure means 50 is thus unlatched and spring 59 can shift valve closure means 50 to its second position.

Return to Normal Operation

Returning safety valve 120 to normal operation varies significantly from safety valve 20 because sufficient force must be applied to compress spring 79 rather than merely equalizing fluid pressures. One method to return safety valve 120 to its first position would be to inject fluid from the well surface at a high enough flow rate such that the force of fluids flowing through openings 53 compresses spring 79. As previously noted openings 53 are designed for minimum restriction to flow. Thus this method may not always be practical for safety valve 120.

Preferrably, a wireline tool string with an appropriate well tool would be lowered through the well flow conductor to engage actuator sleeve 131. Force applied by the wireline tool string would be transmitted to flange 100 moving valve extension 152 to its second position and compressing spring 79. When valve closure means 50 was latched in its first position, the wireline tool string would be removed from the well flow conductor and safety valve 120 operated normally.

Throughout this written description reference has been made to gas storage wells. Safety valves 20 and 120 could also be used in regular gas wells if desired. Since liquids are not generally compressable, only a very slight movement of piston means 37 in one direction would equalize a large pressure difference between longitudinal flow passageway 32 and variable volume chamber 40 when filled with a liquid. Therefore, variable volume chamber 40 should preferably be filled with gas as compared to a liquid.

The preceding written description explains only two embodiments of the present inventions. Those skilled in the art will readily see other modifications and variations without departing from the scope of the invention which is defined by the claims.

What is claimed is:

1. A safety valve for installation within a well flow conductor comprising:

a. a housing means with a longitudinal flow passageway extending therethrough;

b. a valve closure means having a first position allowing fluid flow through the longitudinal flow passageway and a second blocking fluid flow through the longitudinal flow passageway;

c. means for latching the valve closure means in its first position;

d. an actuator sleeve slidably disposed within the housing means and partially defining the longitudinal flow passageway;

e. a piston means attached to the actuator sleeve and partially defining a variable volume chamber between the exterior of the actuator sleeve and the interior of the housing means;

f. means for equalizing fluid pressure between the chamber and fluid pressure exterior to the housing means;

g. the actuator sleeve having means for releasing the latching means; and h. means for shifting the valve closure means from its first position to its second position after the latching means has been released.

2. A safety valve, as defined in claim 1, wherein the latching means further comprises:

a. the valve closure means having a valve extension slidably disposed between the exterior of the actuator sleeve and the interior of the housing means;

b. a plurality of radial openings through the valve extension;

c. a ball disposed within each radial opening;

d. an annular groove on the interior of the housing means and sized to be engaged by the balls; and e. the longitudinal spacing of the annular groove and radial openings selected such that the valve closure means is in its first position when the balls engage the annular groove.

3. A safety valve, as defined in claim 1, wherein the means for releasing the latching means comprises an annular groove on the actuator sleeve near the end opposite the piston means.

4. A safety valve, as defined in claim 1, wherein the means for shifting the valve closure means comprises:

a. a flange on the end of the actuator sleeve opposite the piston means; and b. a shoulder on the valve closure means facing the flange and engageable therewith to allow the actuator sleeve to shift the valve closure means from its first position to its second position.

5. A safety valve, as defined in claim 1, wherein the means for shifting the valve closure means further comprises:

a. the valve closure means having a valve extension slidably disposed between the exterior of the actuator sleeve and the interior of the housing means;

b. a recess formed on the interior of the housing means spaced longitudinally between the chamber and the end of the housing means adjacent to the valve closure means;

c. a flange on the valve extension slidably disposed within the recess;

d. a shoulder within the recess facing the flange; and e. a spring, disposed within the recess, having one end abutting the flange and the other end abutting the shoulder whereby the spring is compressed when the valve closure means is in its first position and the spring shifts the valve closure means to its second position after the latching means has been released.

6. A safety valve, as defined in claim 1, further comprising:

a. an annulus formed between the exterior of the actuator sleeve and the interior of the housing means with the piston means slidably disposed therein;

b. a portion of the annulus comprising the variable volume chamber; and c. the equalizing means comprising a port extending from the chamber through the housing means and allowing fluid communication with the exterior of the safety valve.

7. A safety valve, as defined in claim 1, wherein the valve closure means further comprises:

a. a valve extension slidably disposed between the actuator sleeve and the interior of the housing means;

b. a poppet type valve means attached to the valve extension; and c. annular sealing means on the exterior of the valve means engageable with a valve seat on one end of the housing means.

8. A safety valve, as defined in claim 1, further comprising means for releasably locking the safety within the well flow conductor.

9. A safety valve for installation within a well flow conductor comprising:

a. a housing means;

b. means for locking the safety valve within the well flow conductor;

c. a longitudinal flow passageway extending through the housing means;

d. an actuator sleeve slidably disposed within the housing means and partially defining the longitudinal flow passageway;

e. an annulus formed between the exterior of the actuator sleeve and the interior of the housing means;

f. piston means slidably disposed within the annulus and attached to one end of the actuator sleeve;

g. seal means carried by the housing means and engaging the exterior of the sleeve spaced longitudinally from the piston means;

h. a variable volume gas chamber, formed within the annulus between the piston means and seal means, biasing the actuator sleeve to slide longitudinally in one direction with respect to the housing means when fluid pressure within the chamber is higher than fluid pressure in the longitudinal flow passageway;

i. a valve closure means at least partially disposed within the housing means having a first position allowing fluid flow through the longitudinal flow passageway and a second position blocking fluid flow through the longitudinal flow passageway; and j. means for latching the valve closure means in its first position to the housing means until fluid pressure within the chamber exceeds fluid pressure within the longitudinal passageway by a preselected value.

10. A safety valve, as defined in claim 9, wherein the latching means further comprises:

a. the valve closure means having a valve extension slidably disposed between the exterior of the actuator sleeve and the interior of the housing means;

b. a plurality of radial openings through the valve extension;

c. a ball disposed within each radial opening;

d. an annular groove on the interior of the housing means and sized to be engaged by the balls; and e. the longitudinal spacing of the annular groove and radial openings selected such that the valve closure means is in its first position when the balls engage the annular groove.

11. A safety valve, as defined in claim 10, further comprising:

a. means for releasing the latching means carried on the actuator sleeve; and b. means for shifting the valve closure means from its first position to its second position after the latching means has been released.

12. A safety valve, as defined in claim 11, wherein the means for releasing the latching means comprises an annular groove near the end of the actuator sleeve opposite the piston means.

13. A safety valve, as defined in claim 12, wherein the means for shifting the valve closure means comprises:

a. a flange on the end of the actuator sleeve opposite the piston means; and b. a shoulder on the valve closure means facing the flange and engageable therewith to allow the actuator sleeve to shift the valve closure means from its first position to its second position.

14. A safety valve, as defined in claim 12, wherein the means for shifting the valve closure means further comprises:

a. the valve closure means having a valve extension slidably disposed between the exterior of the actuator sleeve and the interior of the housing means;

b. a recess formed on the interior of the housing means spaced longitudinally between the chamber and the end of the housing means adjacent to the valve closure means;

c. a flange on the valve extension slidably disposed within the recess;

d. a shoulder within the recess facing the flange; and e. a spring, disposed within the recess, having one end abutting the flange and the other end abutting the shoulder whereby the spring is compressed when the valve closure means is in its first position and the spring shifts the valve closure means to its second position after the latching means has been released.

15. A safety valve, as defined in claim 12, further comprising a port extending from the chamber through the housing means and allowing fluid communication with the exterior of the safety valve.

16. A safety valve, as defined in claim 12, wherein the valve closure means further comprises:

a. the valve extension slidably disposed between the actuator sleeve and the interior of the housing means;

b. a poppet type valve means attached to the valve extension; and c. annular sealing means on the exterior of the valve means engageable with a valve seat on one end of the housing means.

* * * * *